US010908547B2

(12) United States Patent
Kusuda

(10) Patent No.: US 10,908,547 B2
(45) Date of Patent: Feb. 2, 2021

(54) IMAGE FORMING SYSTEM FORMING SPECIFIC IMAGE AT SET POSITION

(71) Applicant: KYOCERA Document Solutions Inc., Osaka (JP)

(72) Inventor: Hayato Kusuda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/696,942

(22) Filed: Nov. 26, 2019

(65) Prior Publication Data

US 2020/0174414 A1 Jun. 4, 2020

(30) Foreign Application Priority Data

Nov. 30, 2018 (JP) ..... 2018-225292

(51) Int. Cl.
*G03G 15/00* (2006.01)

(52) U.S. Cl.
CPC ..... *G03G 15/655* (2013.01); *G03G 15/6538* (2013.01); *G03G 15/6547* (2013.01); *G03G 15/6582* (2013.01); *G03G 2215/0089* (2013.01); *G03G 2215/00894* (2013.01); *G03G 2215/00902* (2013.01)

(58) Field of Classification Search
CPC ..... G03G 15/6538; G03G 15/6547; G03G 15/655; G03G 15/6582; G03G 2215/0089; G03G 2215/00894; G03G 2215/00902
See application file for complete search history.

(56) References Cited

U.S. PATENT DOCUMENTS 6,227,531 B1 * 5/2001 Guerrero ..... B65H 33/04 270/1.01

FOREIGN PATENT DOCUMENTS

JP 2010181639 A 8/2010

* cited by examiner

*Primary Examiner* — Joseph S Wong
(74) *Attorney, Agent, or Firm* — Alleman Hall Creasman & Tuttle LLP

(57) ABSTRACT

An image forming system includes an image forming portion, a stack portion, a specific image processing portion, and a setting processing portion. The image forming portion forms an image on a sheet based on image data. The stack portion stores a stack of sheets on which images have been formed by the image forming portion. The specific image processing portion causes the image forming portion to form a specific image on a specific sheet that is discharged to the stack portion before or after one or more sheets on which one or more images have been formed by the image forming portion based on the image data. The setting processing portion sets a specific image formation position on the specific sheet so that the specific image is formed at the specific image formation position.

4 Claims, 15 Drawing Sheets

FIG. 11

8A

STORAGE PORTION

| ORDER (REVERSE TO RECEPTION ORDER) | ID INFORMATION OF INFORMATION PROCESSING APPARATUS 102 | SPECIFIC IMAGE FORMATION POSITION P3 |
|---|---|---|
| 1 | ID INFORMATION A | RIGHT |
| 2 | ID INFORMATION B | LEFT |
| : | : | : |

IMAGE FORMING SYSTEM FORMING SPECIFIC IMAGE AT SET POSITION

INCORPORATION BY REFERENCE

This application is based upon and claims the benefit of priority from the corresponding Japanese Patent Application No. 2018-225292 filed on Nov. 30, 2018, the entire contents of which are incorporated herein by reference.

BACKGROUND

The present disclosure relates to an image forming system.

There is known an image forming apparatus in which images are formed on a plurality of sheets in sequence based on image data. The plurality of sheets having images formed thereon are stacked on a discharge tray (stack portion) in sequence. In the image forming apparatus, identification information of a user is formed on a sheet before or after a predetermined sheet (for example, an initial sheet). The sheet having the identification information formed thereon (what is called a slip sheet) is discharged to the stack portion so as to be used to sort the sheets stacked on the stack portion.

SUMMARY

An image forming system according to an aspect of the present disclosure includes an image forming portion, a stack portion, a specific image processing portion, and a setting processing portion. The image forming portion forms an image on a sheet based on image data. The stack portion stores a stack of sheets on which images have been formed by the image forming portion. The specific image processing portion causes the image forming portion to form a specific image on a specific sheet that is discharged to the stack portion before or after one or more sheets on which one or more images have been formed by the image forming portion based on the image data. The setting processing portion sets a specific image formation position on the specific sheet so that the specific image is formed at the specific image formation position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 11 is a diagram showing identification information and formation position stored in a storage portion shown in FIG. 2.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

Figure 1:
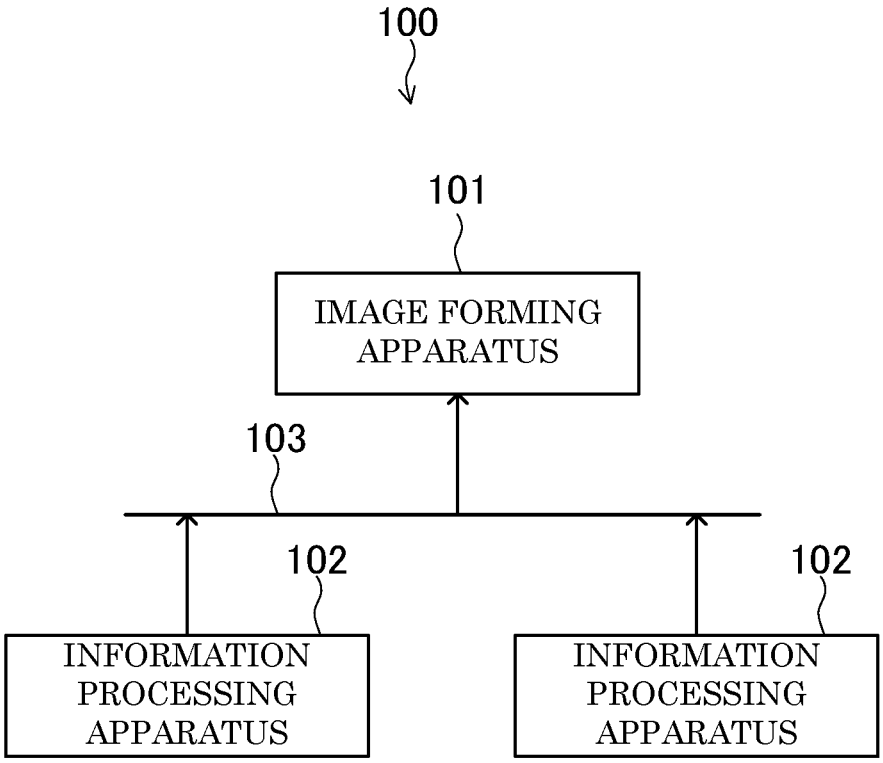
FIG. 1 is a diagram showing a configuration of an image forming system according to an embodiment of the present disclosure.

As shown in FIG. 1, an image forming system 100 includes an image forming apparatus 101 and a plurality of information processing apparatuses 102. The plurality of information processing apparatuses 102 are communicably connected with the image forming apparatus 101 via a network 103.

Figure 2:
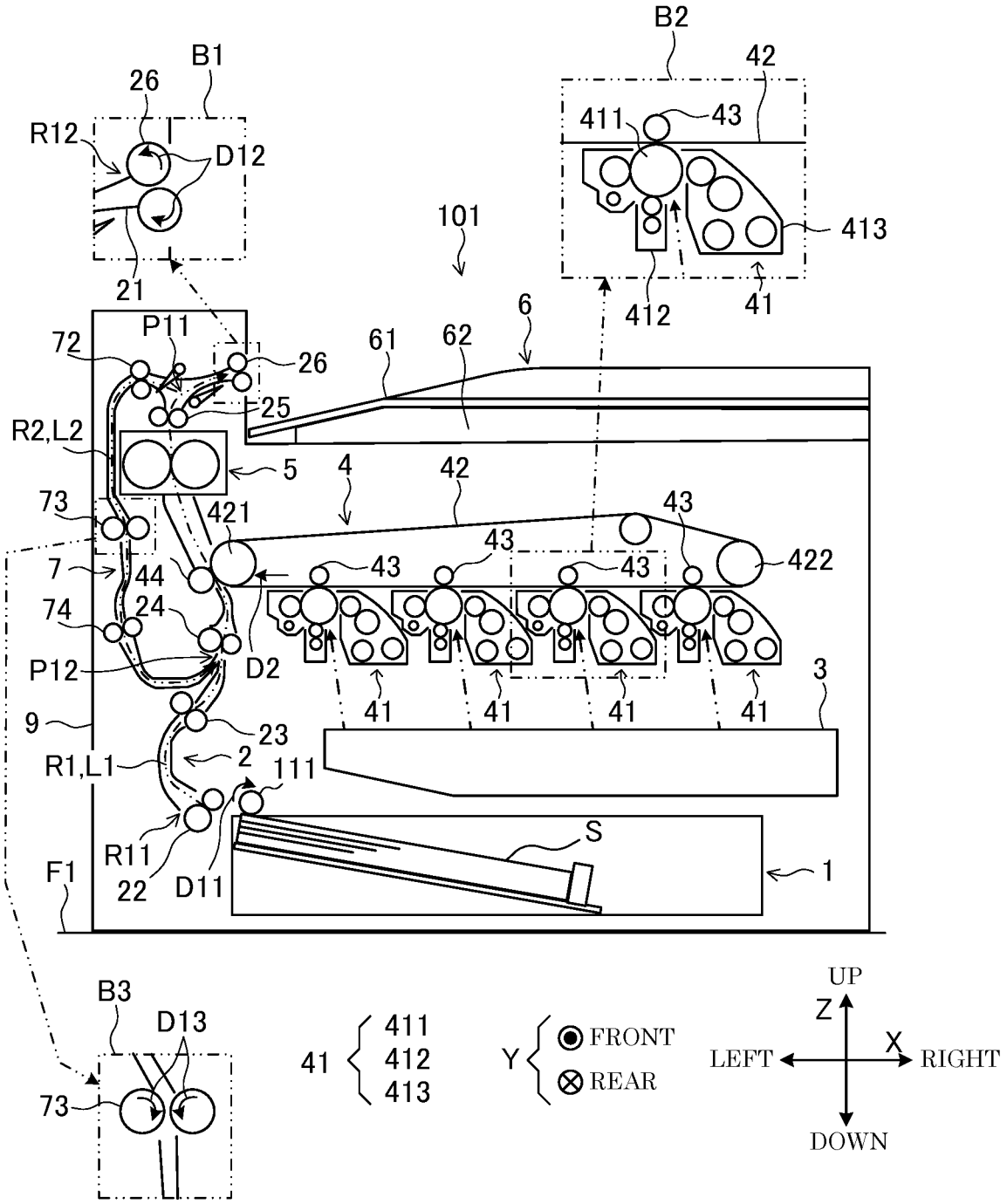
FIG. 2 is a schematic diagram showing a configuration of an image forming apparatus shown in FIG. 1.

Referring to FIG. 2, the X, Y and Z axes indicate the left-right, front-rear and up-down directions of the image forming apparatus 101, respectively.

The image forming apparatus 101 is, for example, a copier, a printer, a facsimile, or a multifunction peripheral. The multifunction peripheral has a plurality of functions such as a copy function, a print function, and a facsimile function. Specifically, the image forming apparatus 101 includes, in a housing 9, a sheet feed portion 1, a first conveyance portion 2, an exposure portion 3, an image forming portion 4, a fixing portion 5, a second conveyance portion 7, and a control portion 8 (see FIG. 3). The image forming apparatus 101 further includes a stack portion 6 above the housing 9.

The sheet feed portion 1 is disposed in the housing 9 close to a bottom of the housing 9. The sheet feed portion 1 is configured to store a plurality of sheets S (for example, paper sheets). The sheet feed portion 1 includes a sheet feed roller 111. The sheet feed roller 111 rotates in a first rotation direction D11 to feed a sheet S toward a pair of rollers 22.

A first conveyance path R1 (indicated by a two-dot chain line L1 in the drawing) is provided in the housing 9. The first conveyance path R1 extends upward from an upstream end R11 at the left of the sheet feed portion 1, and passes the left-end side of the inside of the housing 9. The first conveyance path R1 extends up to a downstream end R12 (see inside a frame B1 in the drawing) located close to the top of the housing 9 and at the left of the stack portion 6.

The first conveyance portion 2 includes a plurality of pairs of rollers 22 to 26. Specifically, a pair of rollers 22 is disposed at a lower right of the upstream end R11. Pairs of rollers 23, 24 and 25 are disposed respectively at the downstream of pairs of rollers 22, 23 and 24 along the first conveyance path R1. A pair of rollers 26 is disposed at the right of the downstream end R12. The pairs of rollers 22 to 26, when they rotate in a second rotation direction D12 (see inside the frame B1 in the drawing), convey the sheet S along the first conveyance path R1, and discharge the sheet S to the stack portion 6.

The exposure portion 3 is provided above the sheet feed portion 1. The exposure portion 3 emits light beams to image carriers 411 based on image data A1 transmitted from the control portion 8 (see FIG. 3).

The image forming portion 4 is provided above the exposure portion 3, and forms images on sheets S based on the image data A1. Specifically, the image forming portion 4 includes a plurality of image creating portions 41, an intermediate transfer belt 42, a plurality of primary transfer portions 43, and a secondary transfer portion 44.

The plurality of image creating portions 41 form images by an electrophotographic method. The plurality of image creating portions 41 correspond to a plurality of colors including yellow, cyan, magenta, and black. The plurality of image creating portions 41 are arranged above the exposure portion 3 in line along the left-right direction. As shown in the frame B2, each of the plurality of image creating portions 41 includes an image carrier 411, a charging portion 412, and a developing portion 413. The charging portion 412, the developing portion 413, and the exposure portion 3 form a toner image of a corresponding color on the image carrier 411.

The intermediate transfer belt 42 is an endless belt, and is stretched among a driving roller 421, a driven roller 422 and the like so that a lower surface of the intermediate transfer belt 42 runs in a running direction D2 along upper ends of the plurality of image carriers 411. The running direction D2 is directed from the right side to the left side of the image forming apparatus 101, and is parallel to an installment plane F1 of the image forming apparatus 101.

The primary transfer portions 43 are primary transfer rollers or the like and are provided in correspondence with the plurality of image carriers 411. The primary transfer portions 43 are respectively disposed to face the image carriers 411 from above across the intermediate transfer belt 42. The primary transfer portions 43 allow the images on the image carriers 411 to be transferred to a lower surface of the intermediate transfer belt 42. The images of respective colors are overlaid on a same area of the lower surface of the intermediate transfer belt 42. As a result, a color image is formed on the lower surface of the intermediate transfer belt 42 based on the image data A1.

The secondary transfer portion 44 is a secondary transfer roller or the like. The secondary transfer portion 44 and the intermediate transfer belt 42 face each other at a downstream of the pair of rollers 24 in the conveyance direction along the first conveyance path R1, thereby forming a secondary transfer region there. The secondary transfer portion 44 transfers the color image carried on the intermediate transfer belt 42, to the sheet S conveyed along the first conveyance path R1.

The fixing portion 5 is provided at a downstream of the secondary transfer portion 44 and an upstream of the pair of rollers 25 in the conveyance direction along the first conveyance path R1. The fixing portion 5 applies heat and pressure to the sheet S fed from the secondary transfer portion 44 so as to fix the color image to the sheet S.

The stack portion 6 is a discharge tray or the like. Sheets S with images formed thereon by the image forming portion 4 are discharged and stacked on the stack portion 6 in sequence. Specifically, sheets S fed from the fixing portion 5 are discharged by the pair of rollers 26 rotating in the second rotation direction D12, and are stacked on the stack portion 6 in sequence.

Figure 4:
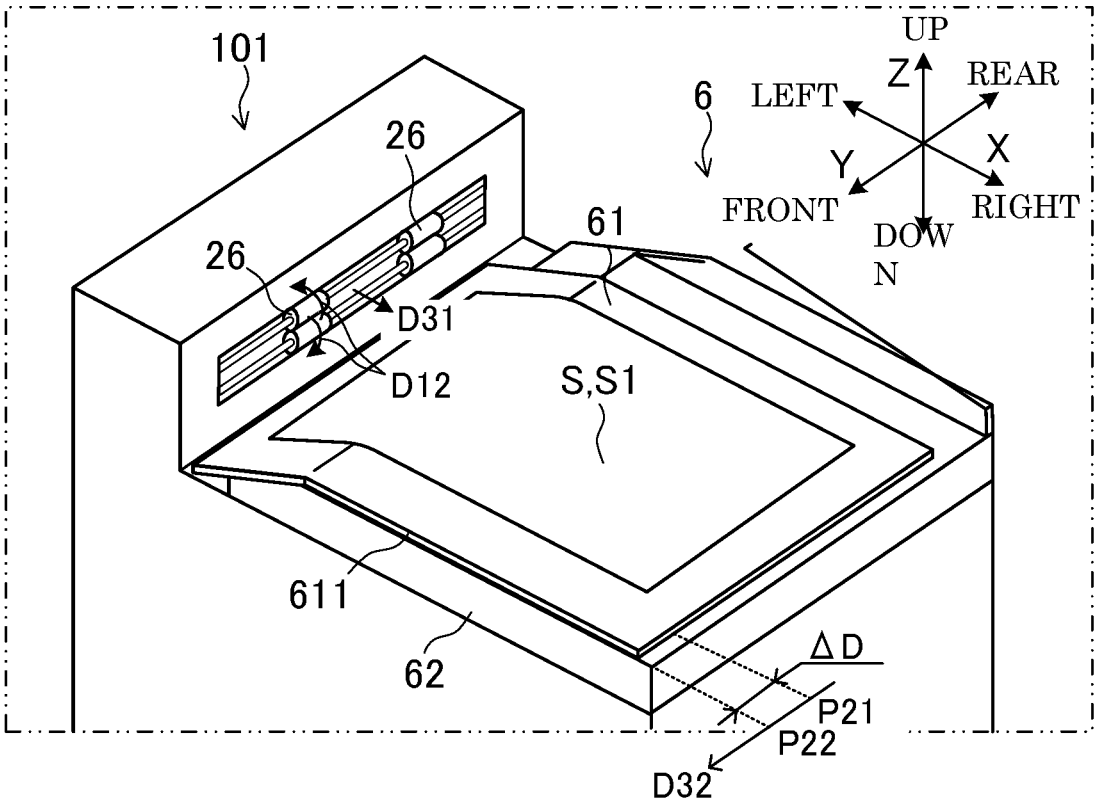
FIG. 4 is a perspective diagram showing a detailed configuration of a stack portion shown in FIG. 2.

As shown in FIG. 4, the stack portion 6 includes a tray portion 61 and a drive portion 62. The sheets S are discharged one by one from the pair of rollers 26 in a discharge direction D31. The discharge direction D31 is perpendicular to the front-rear direction, and is directed from the left side of the image forming apparatus 101 to the right side.

The drive portion 62 includes a motor, a gear and the like, and causes the tray portion 61 to move reciprocally between a first position P21 and a second position P22 in a movement direction D32. Specifically, for example, a front end portion 611 of the tray portion 61 is positioned at the first position P21 and the second position P22. The movement direction D32 is perpendicular to the discharge direction D31, and parallel to the installment plane F1. More specifically, the movement direction D32 is the front-rear direction. At the first position P21, the tray portion 61 is located close to the rear side of the image forming apparatus 101. The second position P22 is separated frontward from the first position P21 by a specific distance ΔD. The drive portion 62 causes the tray portion 61 to move reciprocally so that the plurality of sheets S are stacked on the tray portion 61 in a state of being shifted from each other.

Referring to FIG. 2, a second conveyance path R2 (indicated by a two-dot chain line L2 in the drawing) is provided in the housing 9. The second conveyance path R2 branches from the first conveyance path R1 at a first portion P11 in the first conveyance path R1. The first portion P11 is set to be at a downstream of the fixing portion 5 and an upstream of the pair of rollers 26. The second conveyance path R2 extends from the first portion P11, passes the left side of the first conveyance path R1, and joins the first conveyance path R1 at a second portion P12. The second portion P12 is set to be between the pairs of rollers 23 and 24 in the first conveyance path R1.

The second conveyance portion 7 includes a plurality of pairs of rollers 72 to 74 disposed in the second conveyance path R2. Specifically, a pair of rollers 72 is disposed close to the first portion P11. A pair of rollers 73 is disposed at a downstream of the pair of rollers 72, and a pair of rollers 74 is disposed at a downstream of the pair of rollers 73. When the pairs of rollers 72 to 74 rotate in a third rotation direction D13 (see inside the frame B3), the sheet S fed into the second conveyance path R2 from the first portion P11 is conveyed along the second conveyance path R2 toward the second portion P12.

Figure 3:
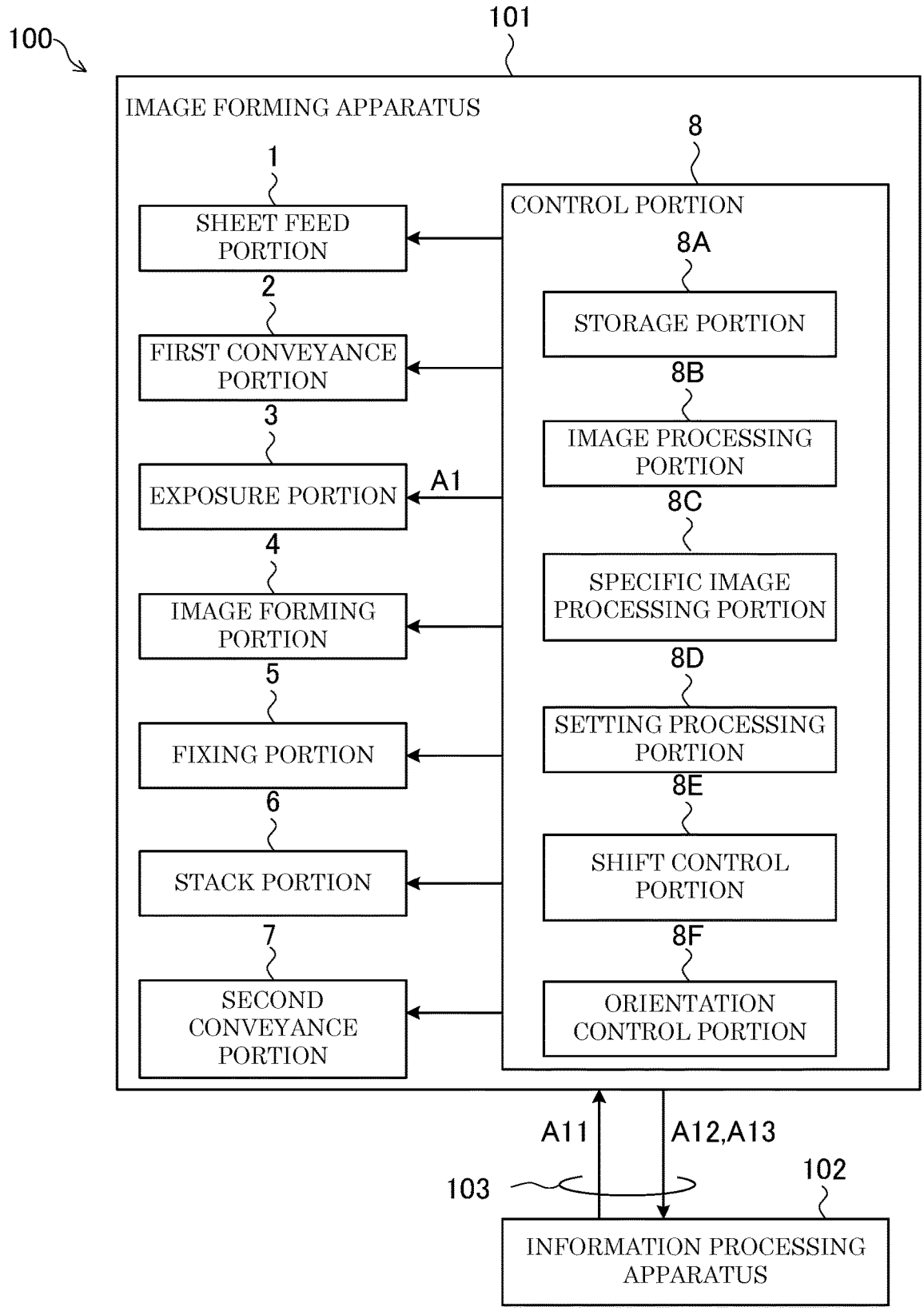
FIG. 3 is a block diagram of the image forming apparatus shown in FIG. 2.

Referring to FIG. 3, the control portion 8 includes a processor, a program storage portion, and a main storage portion, wherein, for example, the program storage portion is a ROM, and the main storage portion is a RAM. The processor executes, by using the main storage portion, a program that is preliminarily stored in the program storage portion. This allows the control portion 8 to control the components (namely, the sheet feed portion 1 and the like) of the image forming apparatus 101 comprehensively. It is noted that the control portion 8 may be an electronic circuit such as an ASIC (Application Specific Integrated Circuit) or a DSP (Digital Signal Processor).

The control portion 8 includes a storage portion 8A, an image processing portion 8B, a specific image processing portion 8C, a setting processing portion 8D, a shift control portion 8E, and an orientation control portion 8F.

Figure 5:
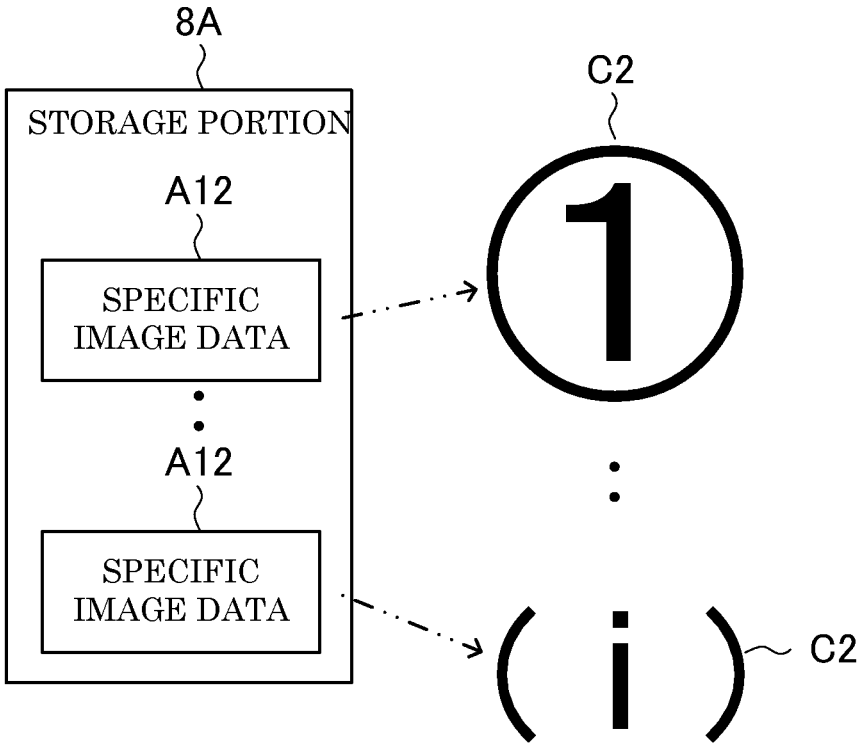
FIG. 5 is a diagram showing specific image data stored in a storage portion shown in FIG. 2.

Referring to FIG. 5, the storage portion 8A is a non-volatile memory device in which one or more pieces of specific image data A12 are preliminarily stored. The specific image data A12 constitutes a part of the image data A1. Each piece of specific image data A12 represents a specific image C2 which is an image having a predetermined pattern. When a plurality of pieces of specific image data A12 are stored, the plurality of pieces of specific image data A12 respectively represent a plurality of specific images C2 that have different patterns in at least one of color, size, and shape. FIG. 5 shows a plurality of specific images C2 that have different patterns in shape.

Referring to FIG. 3, the control portion 8 functions as the storage portion 8A, the image processing portion 8B, the specific image processing portion 8C, the setting processing portion 8D, the shift control portion 8E, and the orientation control portion 8F when the processor executes the program.

The image processing portion 8B is configured to cause the image forming portion 4 to sequentially form one or more images on one or more sheets S based on image data A11 transmitted from any one of the information processing apparatuses 102. The image data A11 constitutes a part of the image data A1, and is an example of image data of the present disclosure.

The specific image processing portion 8C is configured to cause the image forming portion 4 to form a specific image C2 (see FIG. 5) on a specific sheet S that is discharged to the stack portion 6 before or after one or more sheets S, among all sheets S on which images are formed based on the image data A11.

Figure 6A:
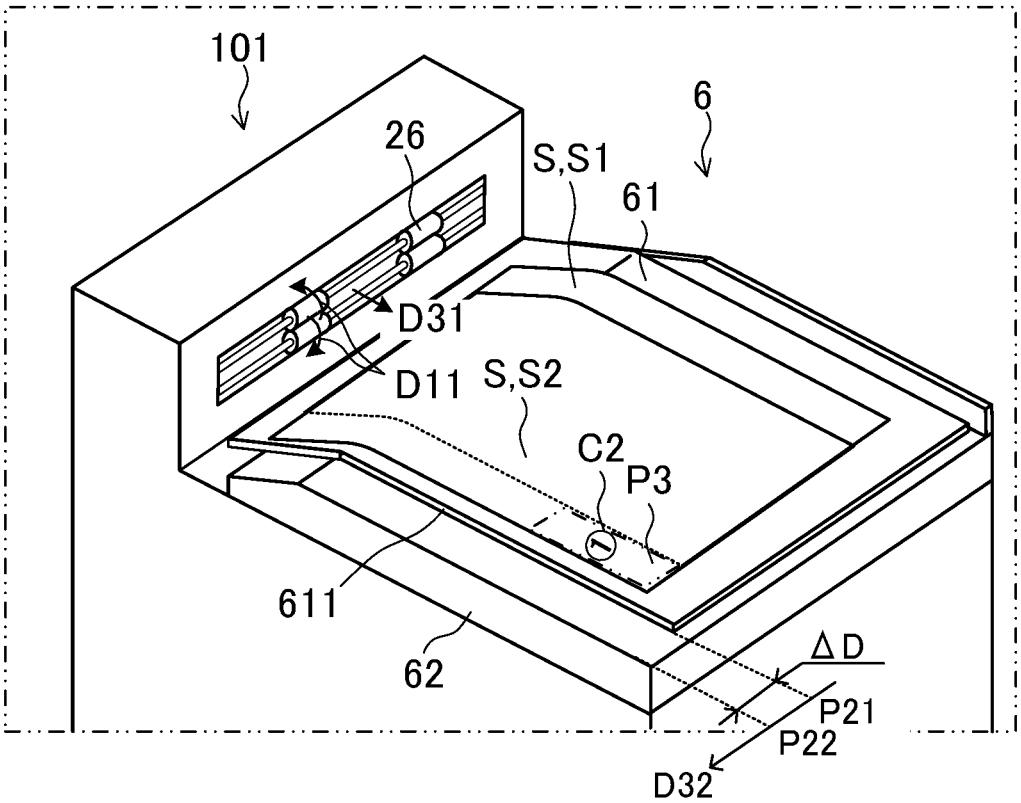
FIG. 6A is a diagram showing a first example of a specific image formation position at which a specific image shown in FIG. 5 is formed.
Figure 6B:
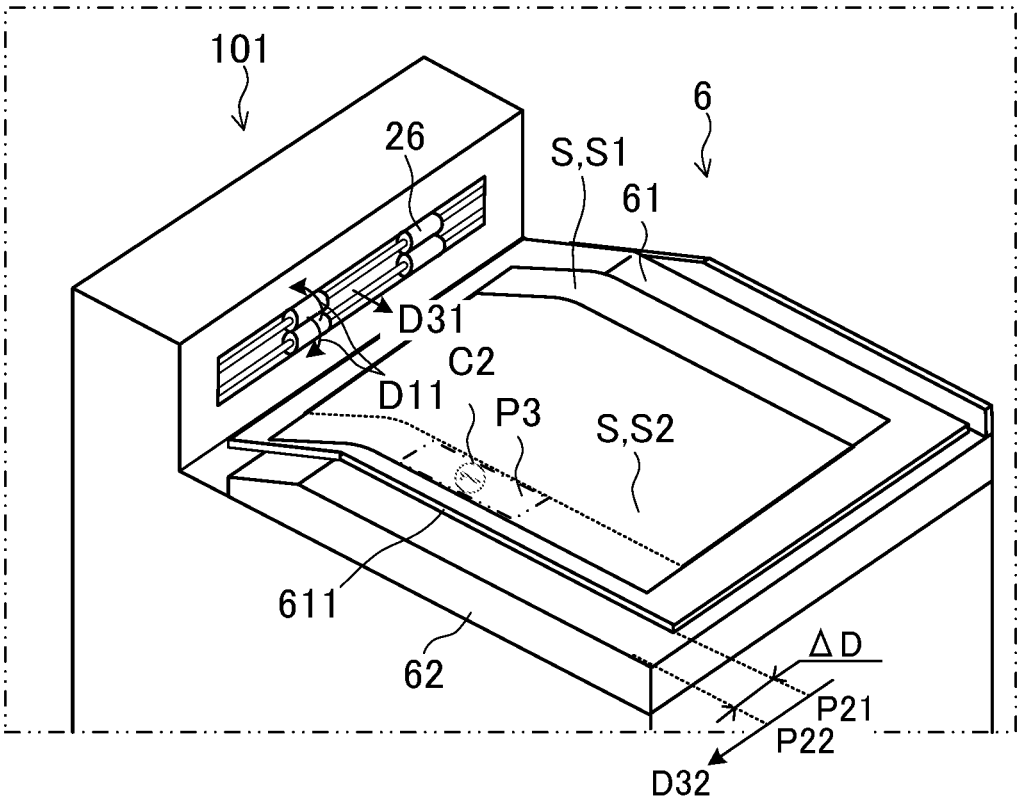
FIG. 6B is a diagram showing a second example of the specific image formation position at which the specific image shown in FIG. 5 is formed.
Figure 8:
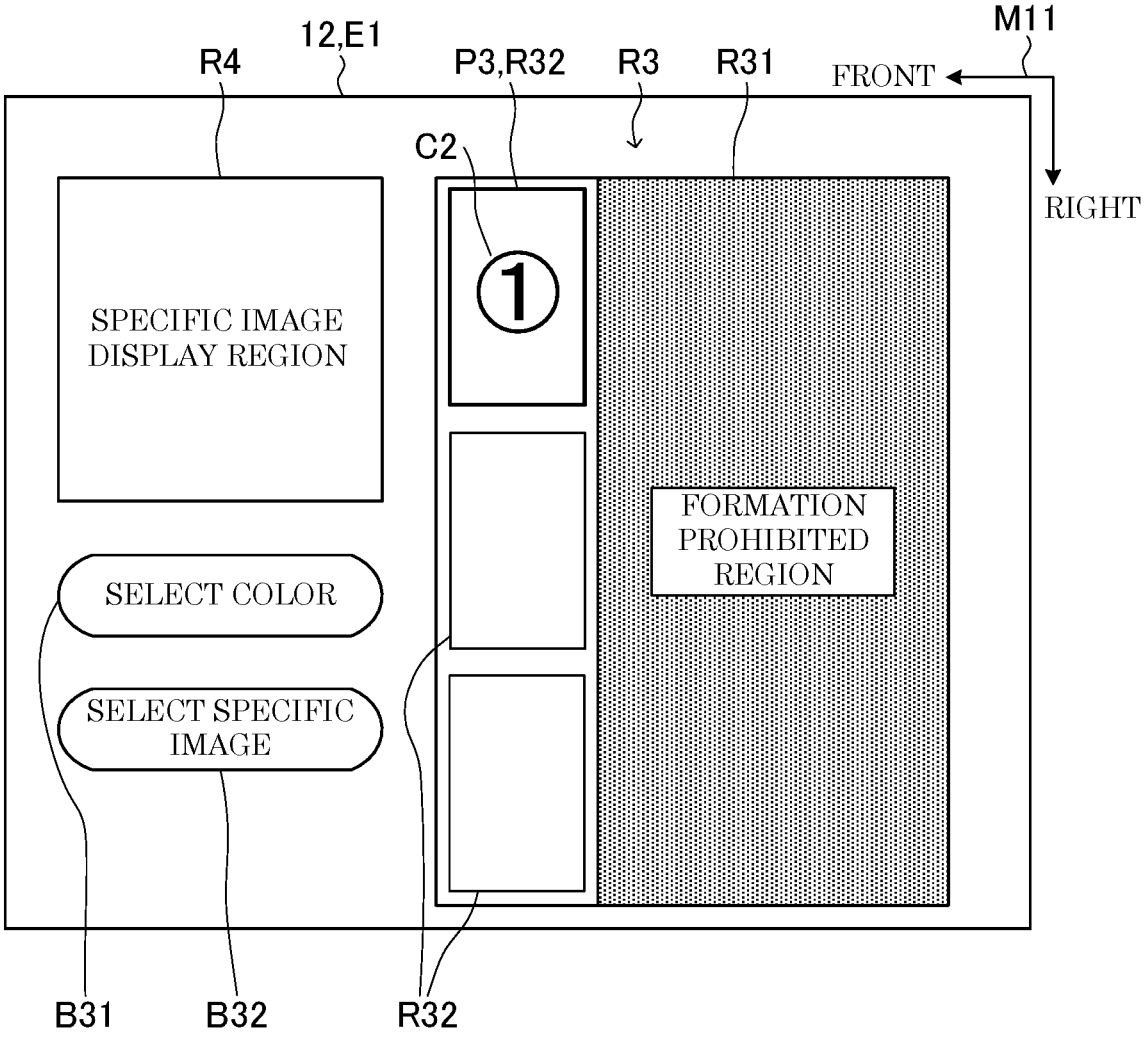
FIG. 8 is a diagram showing an example of a screen displayed on a display portion shown in FIG. 7.

The setting processing portion 8D is configured to set a specific image formation position P3 on the specific sheet S so that the specific image C2 is formed at the specific image formation position P3 (see FIG. 6A, FIG. 6B). For example, the setting processing portion 8D selects one of a plurality of predetermined formation-possible regions R32 (see FIG. 8), as the specific image formation position P3. A portion surrounded by the two-dot chain line in FIG. 6A and FIG. 6B indicates a formation available region R32.

The setting processing portion 8D is configured to set a plurality of specific image formation positions P3 that are different from each other (see FIG. 6A, FIG. 6B), in correspondence with a plurality of pieces of image data A11 transmitted from the plurality of information processing apparatuses 102. In addition, the setting processing portion 8D is configured to select one of a plurality of specific images C2 that are represented by the plurality of pieces of specific image data A12, and set the selected specific image C2 to be formed on the specific sheet S, the plurality of specific images C2 being different from each other.

The shift control portion 8E is configured to shift a specific sheet S with a specific image C2 formed thereon (hereinafter, such a specific sheet S is referred to as a second sheet S2) on the stack portion 6, with respect to sheets S on which images have been formed based on the image data A11 (hereinafter, such sheets S are referred to as first sheets S1). It is predetermined that the second sheet S2 is shifted with respect to the first sheets S1 by the distance ΔD in the movement direction D32. The setting processing portion 8D sets the specific image formation position P3 to be included in a region of the second sheet S2 that does not overlap with the first sheets S1 on the stack portion 6.

The orientation control portion 8F is configured to convey the second sheet S2 along the first conveyance path R1 and the second conveyance path R2 and discharges the second sheet S2 to the stack portion 6 so that the second sheet S2 is discharged to the stack portion 6 with the specific image C2 facing upward.

Figure 7:
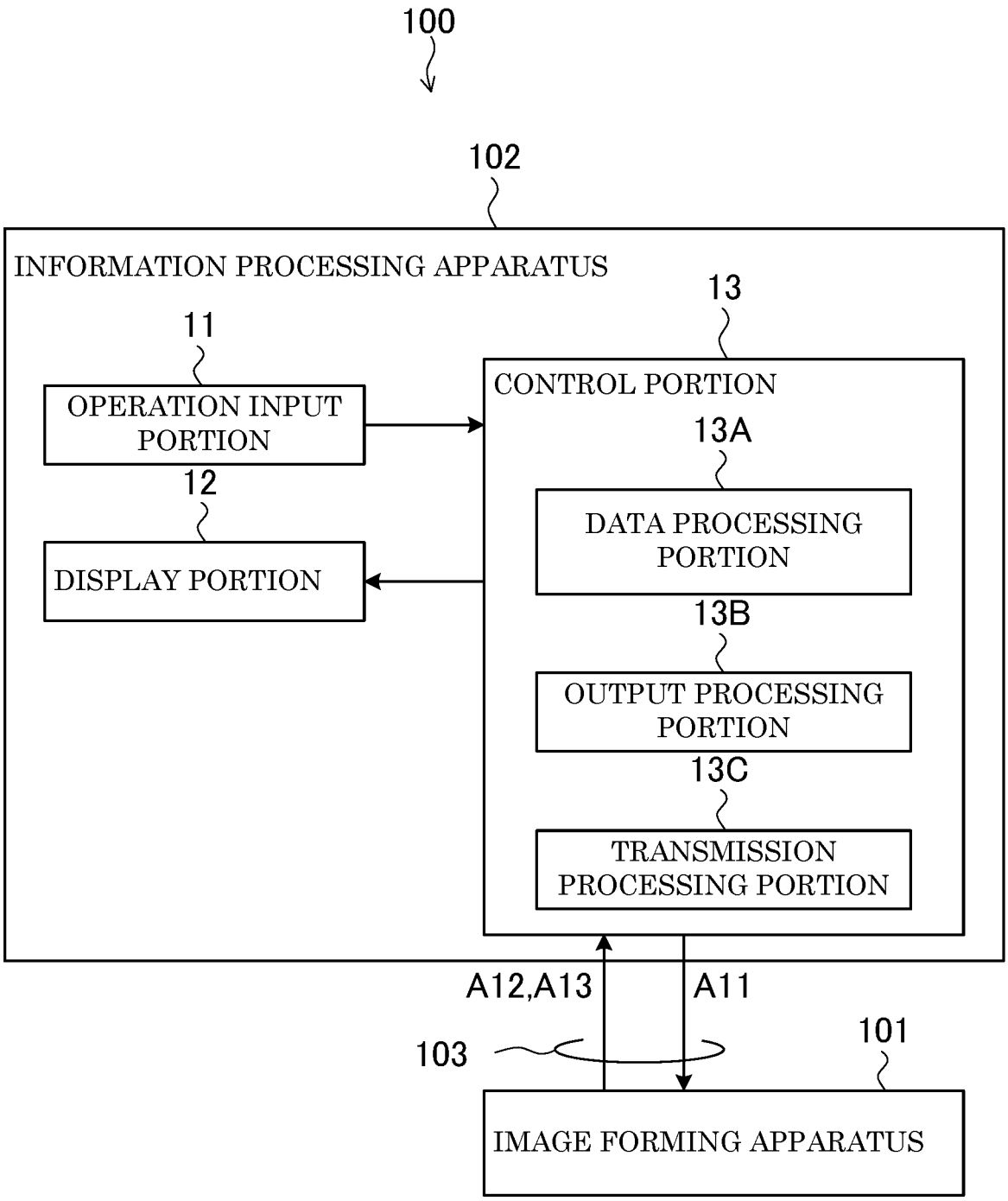
FIG. 7 is a block diagram showing a configuration of an information processing apparatus shown in FIG. 1.

Each of the information processing apparatuses 102 is, for example, a personal computer, and as shown in FIG. 7, includes an operation input portion 11, a display portion 12, and a control portion 13.

The operation input portion 11 includes a keyboard and a mouse and is configured to receive a user operation.

The display portion 12 is, for example, a liquid crystal display, and displays, for example, a screen E1 (see FIG. 8) transmitted from the control portion 13.

The control portion 13 includes a processor, a program storage portion, and a main storage portion, wherein the program storage portion is, for example, a ROM or a hard disk drive, and the main storage portion is, for example, a RAM. The processor executes, by using the main storage portion, an application program that is preliminarily stored in the program storage portion. This allows the control portion 13 to control the components (namely, the display portion 12 and the like) of the information processing apparatus 102.

The control portion 13 includes a data processing portion 13A, an output processing portion 13B, and a transmission processing portion 13C. The control portion 13 functions as the data processing portion 13A, the output processing portion 13B, and the transmission processing portion 13C when it executes the application program.

The data processing portion 13A is configured to generate the image data A11 in accordance with a user operation received by the operation input portion 11.

The output processing portion 13B is configured to output, to the display portion 12, the screen E1 (see FIG. 8) that indicates the specific image formation position P3 set by the setting processing portion 8D. The display portion 12 displays the screen E1.

The transmission processing portion 13C is configured to generate an execution instruction in accordance with a user operation that is received by the operation input portion 11 after the screen E1 is output to the display portion 12. It is noted that the execution instruction includes the image data A11 generated by the data processing portion 13A. The transmission processing portion 13C transmits the execution instruction to the image forming apparatus 101 via the network 103. In the image forming apparatus 101, the image forming portion 4 forms an image(s) on a sheet(s) S based on the image data A11 transmitted from the transmission processing portion 13C.

The following describes the processes of the image forming apparatus 101 and the information processing apparatuses 102 in detail.

Meanwhile, as described above, an image forming apparatus such as the image forming apparatus 101 may form identification information that identifies each user, at a predetermined position of the sheet that is common to all sheets. In that case, however, when a plurality of sheets of a plurality of users are stacked together on the stack portion 6, it is difficult for each user to find his/her sheet(s) even if he/she consults the identification information. On the other hand, according to the image forming system 100 of the present embodiment, each user can find his/her sheet(s)

easily from a plurality of sheets that have images formed thereon and are stacked on the stack portion 6.

Figure 9:
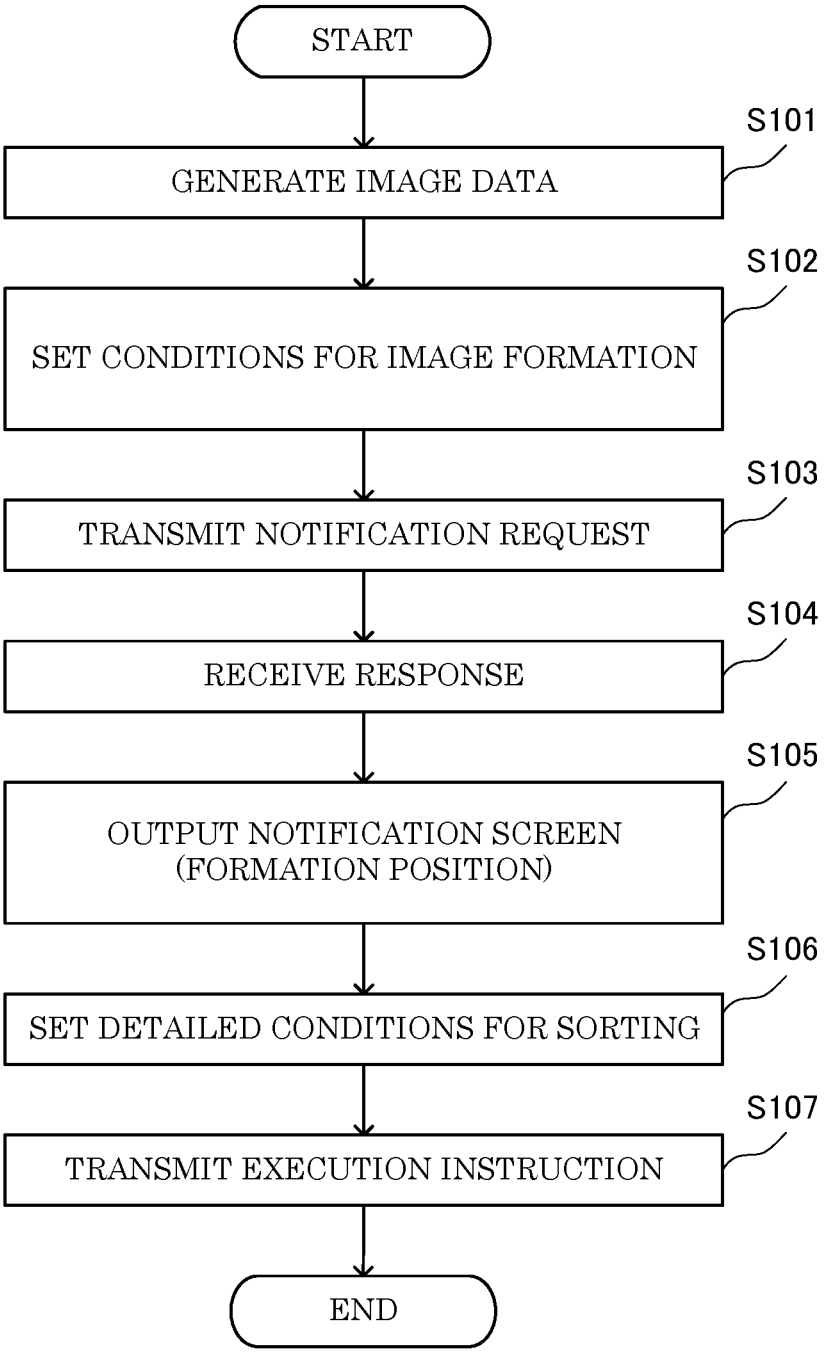
FIG. 9 is a flowchart showing a processing procedure of the information processing apparatus shown in FIG. 7.

In the information processing apparatuses 102, the control portion 13 functions as the data processing portion 13A, and generates the image data A11 based on which images are formed by the image forming apparatus 101 (step S101 of FIG. 9). Subsequently, the control portion 13 sets various conditions for the image formation in accordance with the user operation (step S102). It is noted that although the image forming apparatus 101 can be set to form images on both sides of the sheet S1, the present embodiment describes a case where an image is formed on one side of the sheet S1.

Subsequently, in step S103, the control portion 13 transmits a notification request to the image forming apparatus 101 via the network 103, for setting detailed conditions for a sorting function. The sorting function is also called a slip sheet inserting function and is performed to insert the second sheet S2 before or after one or more first sheets S1 that are specified from the information processing apparatus 102 side. The notification request requests the image forming apparatus 101 to notify the specific image formation position P3 at which the specific image C2 is formed in the second sheet S2, the notification request including identification information that identifies the information processing apparatus 102 that transmits the notification request.

Figure 10A:
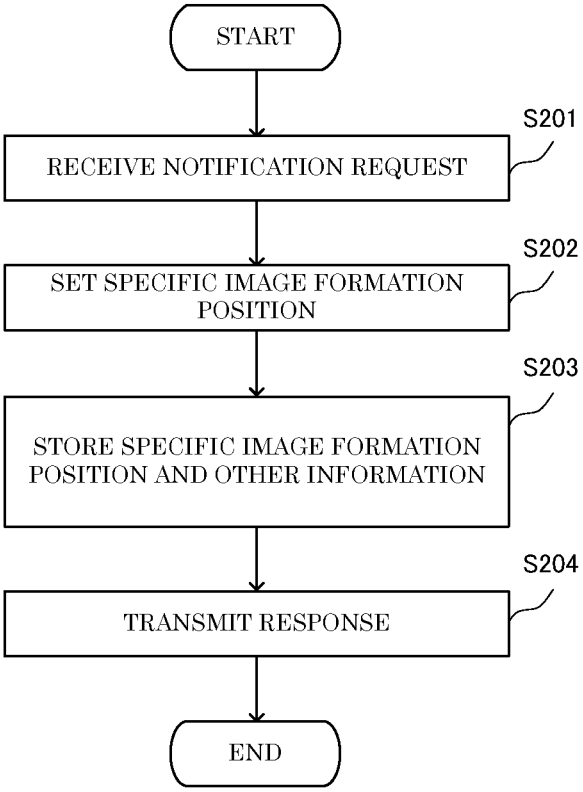
FIG. 10A is a flowchart showing a processing procedure of a process performed by the image forming apparatus shown in FIG. 3 after it receives a notification request.

In the image forming apparatus 101, in response to a reception of the notification request, the control portion 8 sets the specific image formation position P3 that corresponds to the information processing apparatus 102 that transmitted the notification request (see step S202 of FIG. 10A). In addition, the control portion 8 generates a response including image data A13 and a plurality of pieces of specific image data A12, and transmits the response to the information processing apparatus 102 via the network 103 (see step S204 of FIG. 10A), the image data A13 representing the screen E1 shown in FIG. 8.

The screen E1 includes a sheet region R3, a specific image display region R4, a first operation portion B31, a second operation portion B32, and a mark image M11. In the screen E1, the sheet region R3, the specific image display region R4, the first operation portion B31, the second operation portion B32, and the mark image M11 are arranged at different positions.

The sheet region R3 is shaped like the sheet S. The sheet region R3 is divided into a formation prohibited region R31 and a plurality of formation available regions R32. The formation prohibited region R31 is a region in the sheet S where formation of the specific image C2 is prevented. The formation available regions R32 are regions in the sheet S where formation of the specific image C2 is available.

The second sheet S2 is stacked on the stack portion 6 in a state of being shifted with respect to the first sheets S1 (see FIG. 6A and FIG. 6B). Specifically, the formation prohibited region R31 is a region where the second sheet S2 overlaps with the first sheets S1 on the stack portion 6. In addition, the plurality of formation available regions R32 are obtained by dividing a region where the second sheet S2 does not overlap with the first sheets S1, into a plurality of regions. Specifically, the plurality of formation available regions R32 include three (right, left, and intermediate) formation available regions R32.

In the screen E1, one of the plurality of formation available regions R32 selected by the control portion 8 is displayed in a manner different from the remaining ones. In this way, the specific image formation position P3 at which the specific image C2 is formed, is indicated. As one example of the manner in which a formation available region R32 selected by the control portion 8 is displayed differently from the others, the specific image C2 is displayed in the formation available region R32.

In the specific image display region R4, a specific image C2 represented by one of the plurality of pieces of specific image data A12 is displayed.

The first operation portion B31 is a software button that is operated by the user to select a color of the specific image C2 formed on the sheet S.

The second operation portion B32 is a software button that is operated by the user to select one of the plurality of pieces of specific image data A12.

After step S103 of FIG. 9, the control portion 13 receives from the image forming apparatus 101 a response to the notification request (step S104). Thereafter, the control portion 13 functions as the output processing portion 13B, and outputs the screen E1 (see FIG. 8) included in the response, to the display portion 12 (step S105). This allows the user to recognize the specific image formation position P3 at which the specific image C2 is formed in the second sheet S2, and easily find his/her first sheet(s) S1 from the first sheets S1 stacked on the stack portion 6.

Subsequently, the control portion 13 sets detailed conditions for the sorting function based on the user operation (step S106). Specifically, the control portion 13 sets a position at which the second sheet S2 is inserted. The insertion position is before or after one or more specific first sheets S1 among all the first sheets S1 on which images have been formed based on the image data A11. More specifically, the insertion position is, for example, before the initial first sheet S1 or after the last first sheet S1.

It is noted that when the user operates the first operation portion B31 on the operation input portion 11, the control portion 13 can set the color of the specific image C2 in accordance with the user operation. In addition, when the user operates the second operation portion B32 on the operation input portion 11, the control portion 13 can set, in accordance with the user operation, one of a plurality of pieces of specific image data A12 that are transmitted together with the image data A13, as the specific image data A12 that is used for the second sheet S2.

Subsequently, in step S107, the control portion 13 functions as the transmission processing portion 13C. The control portion 13 generates an execution instruction of the image formation, and transmits the execution instruction to the image forming apparatus 101 via the network 103. The execution instruction includes the image data A11 generated in step S101, and information indicating the insertion position, the color, and the specific image data A12 set in step S106.

It is noted that the process of the image forming system 100 without a specification of the sorting function is well known, and description thereof is omitted.

Referring to FIG. 10A, the control portion 8 of the image forming apparatus 101 receives the notification request from an information processing apparatus 102 (step S201). Each time the control portion 8 receives the notification request, it executes the processes of steps S202 to S204.

In step S202, the control portion 8 functions as the setting processing portion 8D, and sets the specific image formation position P3 at which the specific image C2 is formed, for the information processing apparatus 102 that transmitted the notification request to the image forming apparatus 101. Specifically, as shown in FIG. 11, the storage portion 8A stores pieces of identification information included in notification requests, in reverse order to an order in which the notification requests were received. The storage portion 8A further stores specific image formation positions P3 that were set in step S202, in association with the pieces of identification information. The control portion 8 retrieves, from the storage portion 8A, an immediately preceding specific image formation position P3 that corresponds to a notification request that precedes, by one in the order, the notification request received in step S201. The control portion 8 selects a specific image formation position P3 other than the immediately preceding specific image formation position P3 from the plurality of specific image formation positions P3, and sets the selected specific image formation position P3 as the specific image formation position P3 for the information processing apparatus 102 that transmitted the execution instruction. Subsequently, the control portion 8 stores, in the storage portion 8A, the identification information included in the notification request received in step S201, and the specific image formation position P3 set in step S202 (step S203).

The control portion 8 does not set the same specific image formation position P3 for two notification requests that were received in succession. This reduces the possibility that the specific image C2 is formed at the same specific image formation position P3 on two successive second sheets S2 in the up-down direction on the stack portion 6. With this configuration, the user can easily find his/her second sheet S2 on the stack portion 6.

Subsequently, in step S204, the control portion 8 transmits the response to the information processing apparatus 102 via the network 103. Specifically, in the screen E1 (see FIG. 8) included in the response, the control portion 8 displays a formation available region R32 corresponding to the specific image formation position P3 set in step S202, in a manner different from the other formation available regions R32. This allows the user to recognize the specific image formation position P3 at which the specific image C2 is formed, by viewing the screen E1 displayed on the display portion 12 of the information processing apparatus 102.

After the completion of step S204, the control portion 8 ends the process of FIG. 10A.

Figure 10B:
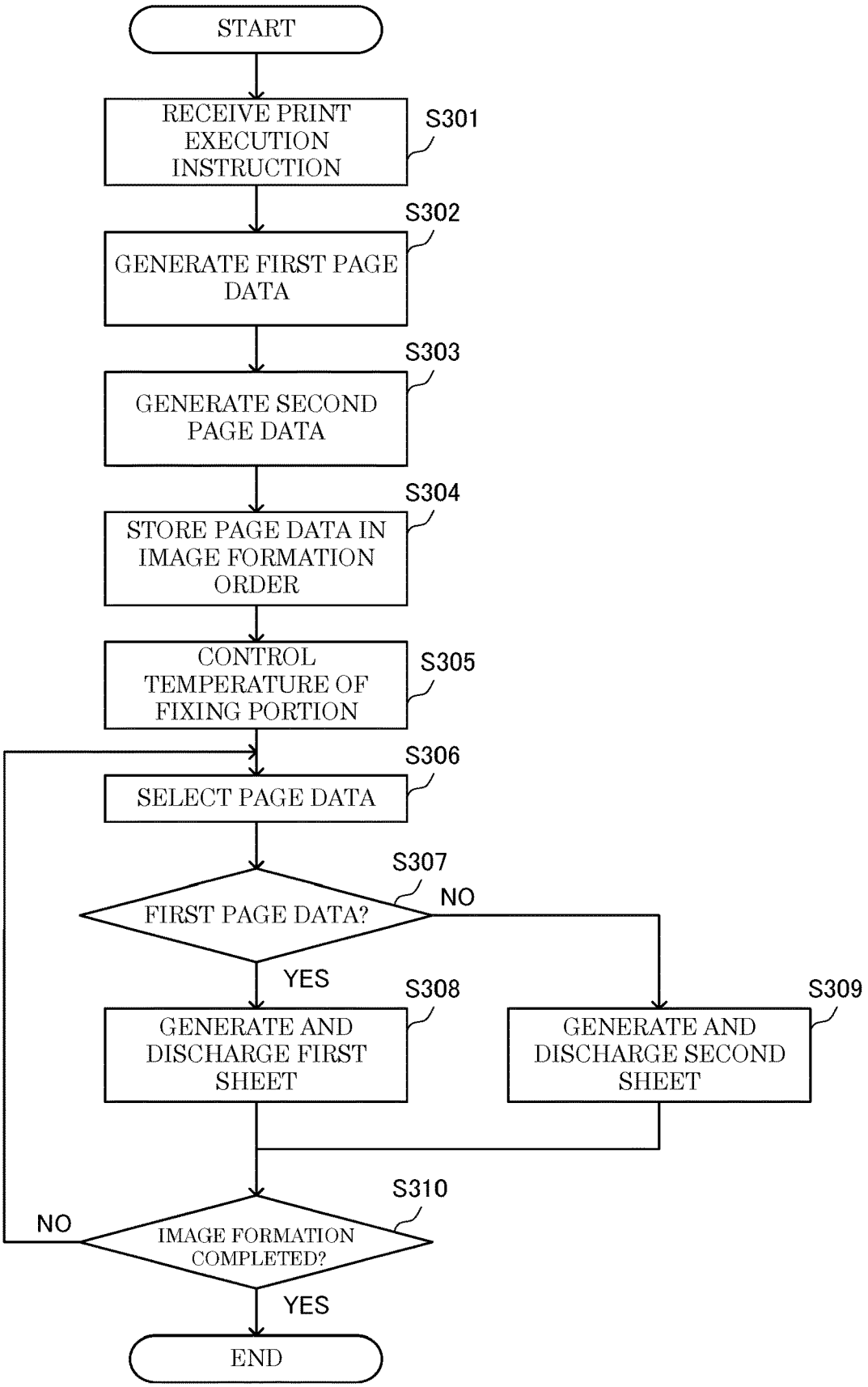
FIG. 10B is a flowchart showing a processing procedure of a process performed by the image forming apparatus shown in FIG. 3 after it receives an execution request.

Referring to FIG. 10B, the control portion 8 receives the execution instruction transmitted from the information processing apparatus 102 (step S301). The control portion 8 executes the processes of steps S302 to S310 in accordance with the received execution instruction.

In step S302, the control portion 8 executes a RIP (Raster Image Process) based on the image data A11 to generate one or more pieces of first page data A14 on the RAM. Each of the one or more pieces of first page data A14 represents an image that is formed on one sheet S. The images represented by the image data A11 are represented by all of the one or more pieces of first page data A14 generated in step S302.

In step S303, the control portion 8 executes the RIP to generate second page data A15 on the RAM. Prior to the generation of the second page data A15, the control portion 8 acquires, from the storage portion 8A (see FIG. 11), a specific image formation position P3 corresponding to the identification information of the information processing apparatus 102 that transmitted the execution instruction. The control portion 8 acquires, from the execution instruction, information indicating the specific image data A12 and a color, and the insertion position. The control portion 8 generates the second page data A15 representing the specific image C2 that is displayed in the color at the specific image formation position P3 of the sheet S1.

In step S304, the control portion 8 stores a plurality of pieces of first page data A14 and second page data A15 in the RAM so that they are output in an image formation order. Specifically, the second page data A15 is stored in the RAM so that it is output before or after one or more pieces of specific first page data A14, in accordance with the insertion position included in the execution instruction.

In step S305, the control portion 8 controls the temperature of the fixing portion 5 to a temperature at which the toner can be fixed to the sheet S.

In step S306, the control portion 8 selects a piece of first page data A14 or the second page data A15 to form an image, in accordance with the image formation order, from not-yet-selected pieces of first page data A14 and the second page data A15 stored in the RAM.

In step S307, the control portion 8 determines whether or not the data selected in step S306 is the first page data A14. Upon determining that the data selected in step S306 is the first page data A14, the control portion 8 moves the process to step S308, and upon determining that the data selected in step S306 is not the first page data A14, the control portion 8 moves the process to step S309.

In step S308, the control portion 8 controls the components of the image forming apparatus 101 so that a first sheet S1 is generated and discharged to the stack portion 6.

Specifically, in step S308, the control portion 8 causes the plurality of pairs of rollers 22 to 26 to rotate in the second rotation direction D12, and the sheet feed roller 111 to rotate in the first rotation direction D11. As a result, one sheet S is supplied from the sheet feed portion 1 into the first conveyance path R1, and the sheet S is conveyed along the first conveyance path R1 by the first conveyance portion 2, and discharged to the stack portion 6.

In step S308, the control portion 8 further functions as the image processing portion 8B. The image processing portion 8B causes the image forming portion 4 to form an image based on the piece of first page data A14 selected in step S306. In addition, the image forming portion 4 transfers an image that is formed based on the piece of first page data A14 (namely, the image data A11) to the sheet S conveyed along the first conveyance path R1, and the fixing portion 5 fixes the image to the sheet S. The fixing portion 5 feeds the sheet S to which the image has been fixed, to the pair of rollers 26 as a first sheet S1. The pair of rollers 26 discharges the first sheet S1 from the fixing portion 5 to the stack portion 6. The first sheet S1 is stacked on the stack portion 6 in a state where the image faces downward.

In step S308, the control portion 8 further controls the drive portion 62 to position the front end portion 611 of the tray portion 61 to the second position P22 (see FIG. 4), at a predetermined timing before the sheet S is discharged to the stack portion 6. It is noted that a reflection-type optical sensor is disposed at an appropriate location in the first conveyance path R1, wherein the reflection-type optical sensor detects the position of the sheet S in the first conveyance path R1. The control portion 8 detects an arrival of the timing based on the detection result of the reflection-type optical sensor.

In step S309, the control portion 8 controls the components of the image forming apparatus 101 to generate the second sheet S2 and discharge it to the stack portion 6.

Specifically, in step S309, the sheet feed roller 111 and the plurality of pairs of rollers 22 to 26 rotate such that one sheet S is fed from the sheet feed portion 1, and the sheet S is conveyed as the specific sheet S along the first conveyance path R1 by the first conveyance portion 2.

In step S309, the control portion 8 further functions as the specific image processing portion 8C. The specific image processing portion 8C causes the image forming portion 4 to form an image based on the second page data A15 selected in step S306. In addition, the image forming portion 4 transfers the specific image C2 that is formed based on the second page data A15 to the sheet S conveyed along the first conveyance path R1, and the fixing portion 5 feeds the specific sheet S to which the specific image C2 has been fixed, to the pair of rollers 26 as the second sheet S2.

Figure 12A:
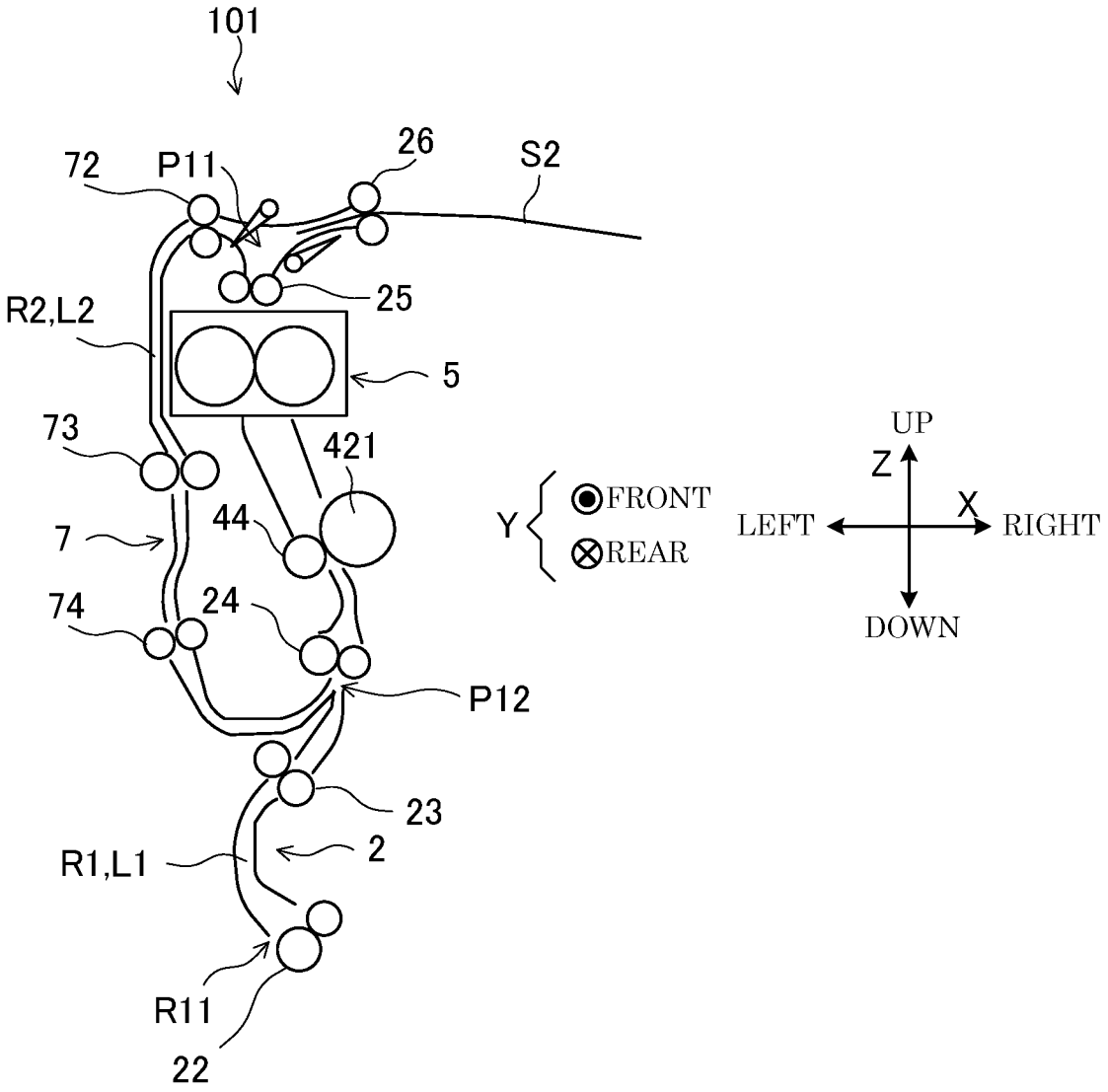
FIG. 12A is a schematic diagram showing a first state of a second sheet.
Figure 12B:
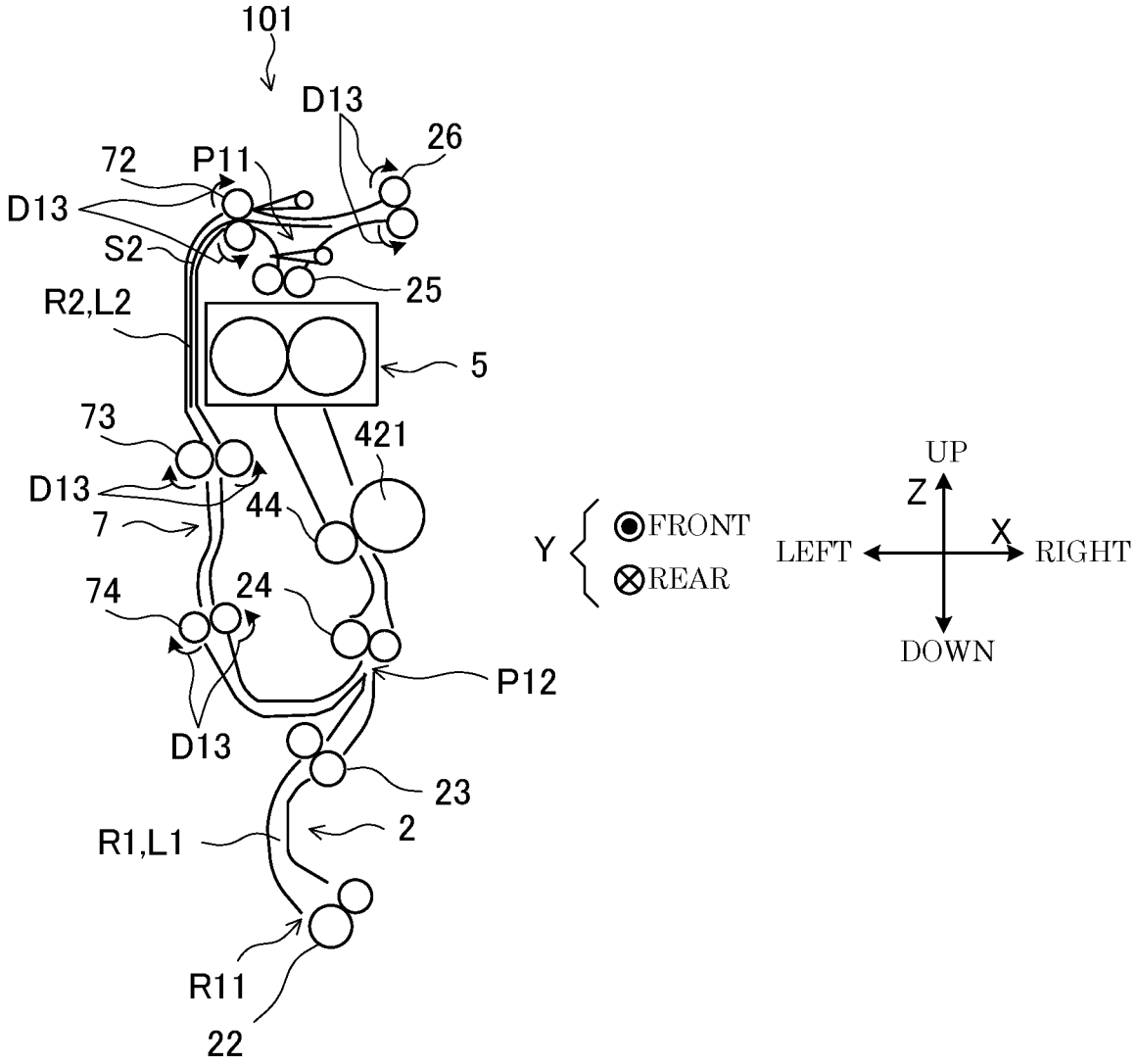
FIG. 12B is a schematic diagram showing a second state of the second sheet.
Figure 12C:
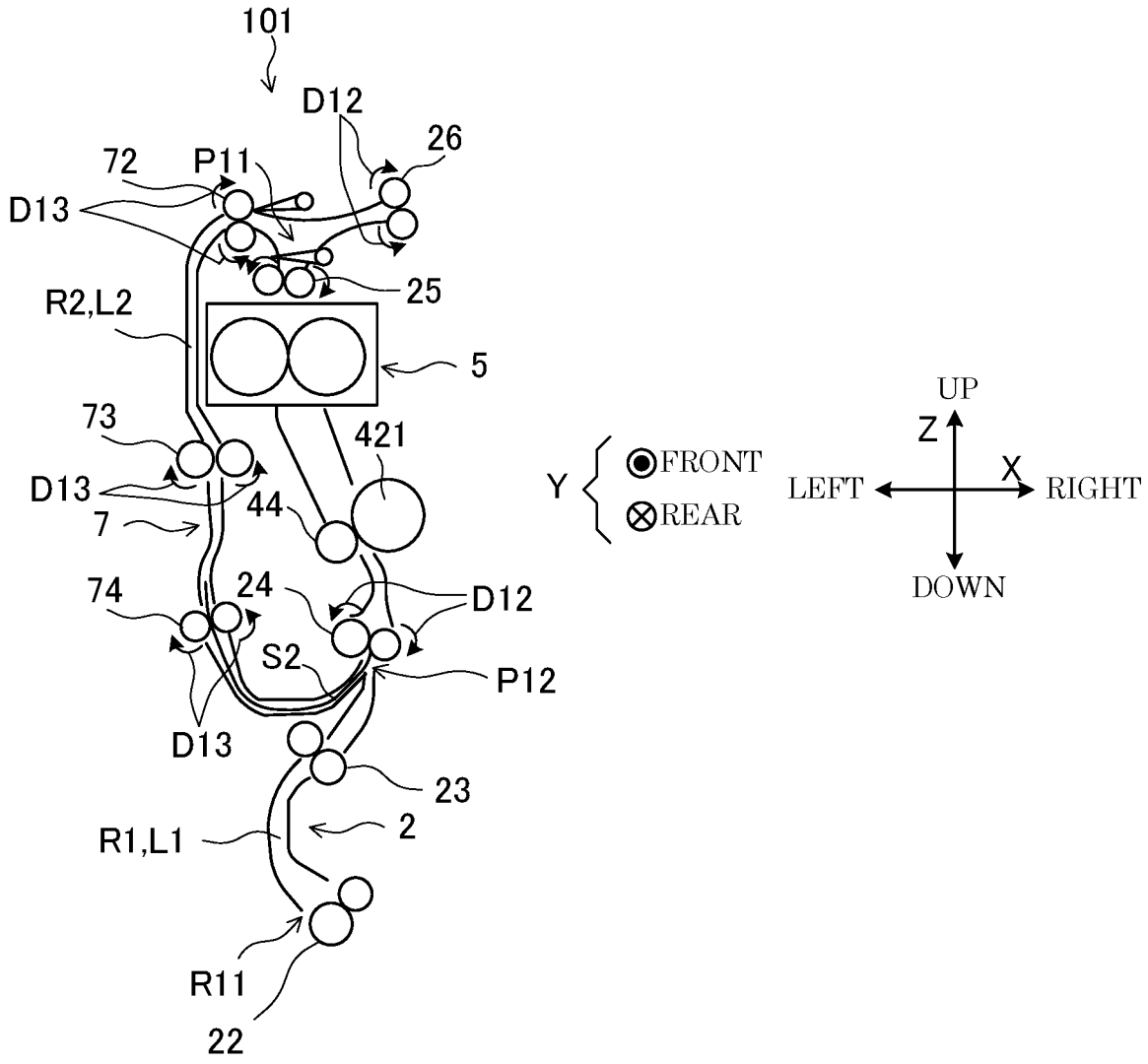
FIG. 12C is a schematic diagram showing a third state of the second sheet.

In step S309, the control portion 8 further functions as the orientation control portion 8F. The orientation control portion 8F stops the rotation of the pair of rollers 26 at a timing when, as shown in FIG. 12A, the rear end of the second sheet S2 in the conveyance direction reaches the first portion P11 and the pair of rollers 26, based on the detection result of the reflection-type optical sensor. Thereafter, as shown in FIG. 12B, the orientation control portion 8F rotates the pairs of rollers 26 and 72 to 74 in the third rotation direction D13 that is opposite to the second rotation direction D12. As a result, the second sheet S2 is guided from the first portion P11 into the second conveyance path R2, and conveyed along the second conveyance path R2 by the second conveyance portion 7. In addition, the control portion 8 rotates the pairs of rollers 24 to 26 in the second rotation direction D12 at a timing when, as shown in FIG. 12C, the leading end of the second sheet S2 in the conveyance direction reaches the second portion P12. This allows the second sheet S2 to be fed into the first conveyance path R1 again, and conveyed along the first conveyance path R1 by the first conveyance portion 2. The pair of rollers 26 discharges the second sheet S2 conveyed along the first conveyance path R1 to the stack portion 6. With the control performed by the orientation control portion 8F, the second sheet S2 is placed on the stack portion 6 in a state where the specific image C2 faces upward.

In step S309, the control portion 8 further functions as the shift control portion 8E. The shift control portion 8E controls the drive portion 62 (see FIG. 4) at a predetermined timing before the sheet S is discharged to the stack portion 6 such that the front end portion 611 of the tray portion 61 is positioned at the first position P21. This allows the shift control portion 8E to shift the second sheet S2 with respect to the first sheets S1 on the stack portion 6.

In step S310 after step S308 and step S309, the control portion 8 determines whether or not the image formation has been completed with respect to all pieces of first page data A14 and the second page data A15 stored in the RAM. Upon determining that the image formation has not been completed, the control portion 8 returns the process to step S305, and upon determining that the image formation has been completed, the control portion 8 ends the process of FIG. 10B.

According to the image forming system 100, in the image forming apparatus 101, the setting processing portion 8D sets the specific image formation position P3 at which the specific image C2 is formed. In the information processing apparatus 102, the display portion 12 displays the specific image formation position P3 on the screen E1 output by the output processing portion 13B. This allows the user to recognize the specific image formation position P3 at which the specific image C2 is formed in the second sheet S2. In the image forming apparatus 101, the specific image processing portion 8C causes the image forming portion 4 to form the specific image C2 on the sheet S at the specific image formation position P3. Sheets S are stacked on the stack portion 6 in such manner that the second sheet S2 is inserted before or after one or more first sheets S1. This makes it easy for the user to find the specific image C2 formed at the specific image formation position P3 that was set for the user himself/herself. This makes it easy for the user to find his/her first sheet(s) S1 from the first sheets S1 with images stacked on the stack portion 6.

It is noted that in the present embodiment, the image forming apparatus 101 may be regarded as an image forming system of the present disclosure. In this case, the image forming apparatus 101 may include the output processing portion 13B (see FIG. 7).

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming system comprising:

an image forming portion configured to form an image on a sheet based on image data;

a stack portion configured to store a stack of sheets on which images have been formed by the image forming portion;

a specific image processing portion configured to cause the image forming portion to form a specific image on a specific sheet that is discharged to the stack portion before or after one or more sheets on which one or more images have been formed by the image forming portion based on the image data;

a setting processing portion configured to set a specific image formation position on the specific sheet so that the specific image is formed at the specific image formation position; and a shift control portion configured to shift the specific sheet with respect to the sheets on the stack portion, wherein the setting processing portion is configured to set a plurality of specific image formation positions that are different from each other, in correspondence with a plurality of pieces of the image data, the setting processing portion further selects one of a plurality of specific images that are different from each other, as the specific image that is formed on the specific sheet, an amount by which the specific sheet is shifted with respect to the sheets is predetermined, and the setting processing portion sets the specific image formation position to be included in a region of the specific sheet that does not overlap with the sheets.

2. The image forming system according to claim 1, wherein the specific image is an image having a predetermined pattern.

3. The image forming system according to claim 1, further comprising:

an orientation control portion configured to discharge the specific sheet on which the specific image has been formed by the image forming portion, to the stack portion in a state where the specific image faces upward.

4. The image forming system according to claim 1, further comprising:

an output processing portion configured to output the specific image formation position set by the setting processing portion; and a transmission processing portion configured to transmit the image data after the specific image formation position is output, wherein the image forming portion forms the image on the sheet based on the image data transmitted by the transmission processing portion.

* * * * *